US005303629A

United States Patent [19]

Yokota et al.

[11] Patent Number: 5,303,629

[45] Date of Patent: Apr. 19, 1994

[54] ACOUSTIC DATA OUTPUT DEVICE HAVING SINGLE ADDRESSABLE MEMORY

[75] Inventors: Kazuhiko Yokota; Kazuhisa Mito; Yoshio Kimura, all of Tokyo, Japan

[73] Assignee: Seikosha Co., Ltd., Tokyo, Japan

[21] Appl. No.: 661,729

[22] Filed: Feb. 26, 1991

[30] Foreign Application Priority Data

Feb. 26, 1990 [JP] Japan ..... 2-45095

[51] Int. Cl.[5] ..... G10H 7/00; G10H 1/18

[52] U.S. Cl. ..... 84/615; 84/605; 84/627

[58] Field of Search ..... 84/609-612, 84/615, 634-636, 649-652, 601, 627, 605

[56] References Cited

U.S. PATENT DOCUMENTS

| | | | |
|---|---|---|---|
| 4,108,036 | 8/1978 | Slaymaker | 84/605 |
| 4,202,235 | 5/1980 | Namiki et al. | 84/649 |
| 4,208,938 | 6/1980 | Kondo . | |
| 4,254,681 | 3/1981 | Kugisawa et al. | 84/607 |
| 4,345,501 | 8/1982 | Nakada et al. | 84/612 |
| 4,377,960 | 3/1983 | Okumura . | |
| 4,512,229 | 4/1985 | Kamiya et al. | 84/609 |
| 4,528,884 | 7/1985 | Kawamoto et al. . | |
| 4,936,184 | 6/1990 | Yang | 84/612 |
| 4,972,754 | 11/1990 | Choi | 84/627 |

FOREIGN PATENT DOCUMENTS 3812144 10/1989 Fed. Rep. of Germany .

*Primary Examiner*—William M. Shoop, Jr.
*Assistant Examiner*—Jeffrey W. Donels
*Attorney, Agent, or Firm*—Jordan and Hamburg

[57] ABSTRACT

An acoustic data output device comprises an addressable memory for storing acoustic data. A plurality of clock signals are coupled to count separate address counters of a number corresponding to the number of clock signals. A signal selector is responsive to the clock signals for providing an address counter selection signal, whereby at any given time the selection signal corresponds to a separate one of the address counters. An addressing device is responsive to the address counter selection signal for selectively addressing the addressable memory with the count of the corresponding address counter. A separate data latch corresponds to each address counter and the data latches are coupled to receive the output of said addressable memory. The outputs of the data latches are synchronized with the clock signal corresponding thereto.

5 Claims, 2 Drawing Sheets

ACOUSTIC DATA OUTPUT DEVICE HAVING SINGLE ADDRESSABLE MEMORY

FIELD OF THE INVENTION

This invention relates to an acoustic data output device.

BACKGROUND OF THE INVENTION

In the field of time indicating clocks, a conventional clock operates in such a manner that the acoustic data of, for example, a Westminster chime is read out of an acoustic data output device every 15 minutes to generate a melody. In such a clock, in order to decrease the storage requirements of a storage circuit for acoustic data, the fundamental waveform of one sound of a bell is stored in a ROM in the form of PCM data, for example, whereby a melody can be performed on the basis of the data of-only one sound because the musical scale can be changed by changing the frequency of a clock signal used in reading out the data.

The foregoing conventional clock outputs a melody by repeatedly reading out one data and thus cannot generate a plurality of sounds concurrently in an overlapped mode. Specifically, since a series of sounds is generated one sound after another, it cannot be heard as a series of contiguous sounds, giving only a flat melody or rough music.

SUMMARY OF THE INVENTION

It is an object of the present invention to provide an acoustic data output device capable of generating a deep and comfortable melody using only one acoustic data.

To solve the foregoing problems, the present invention provides an acoustic data output device which comprises an acoustic data storage means in which acoustic data is stored, a plurality of address counters each capable of independently counting in response to a corresponding one of a plurality of clock signals, selection-signal output means for receiving the plurality of clock signals and delivering a selection signal indicating which of the plurality of address counters is to be selected, addressing means for selecting one of the plurality of address counters in accordance with the output signal from the selection-signal output means and addressing the acoustic data storage means with an address corresponding to the count of the selected address counter, and a plurality of acoustic data latch means corresponding to the plurality of address counters for temporarily storing the acoustic data held at the address specified by the addressing means and outputting the temporarily-stored acoustic data in synchronization with the clock signal corresponding to the address counter selected by the addressing means.

BRIEF DESCRIPTION OF THE DRAWINGS

In order to more clearly understand the invention, it will now be disclosed in greater detail with reference to the accompanying drawings, wherein.

DESCRIPTION OF THE PREFERRED EMBODIMENTS

Figure 1:
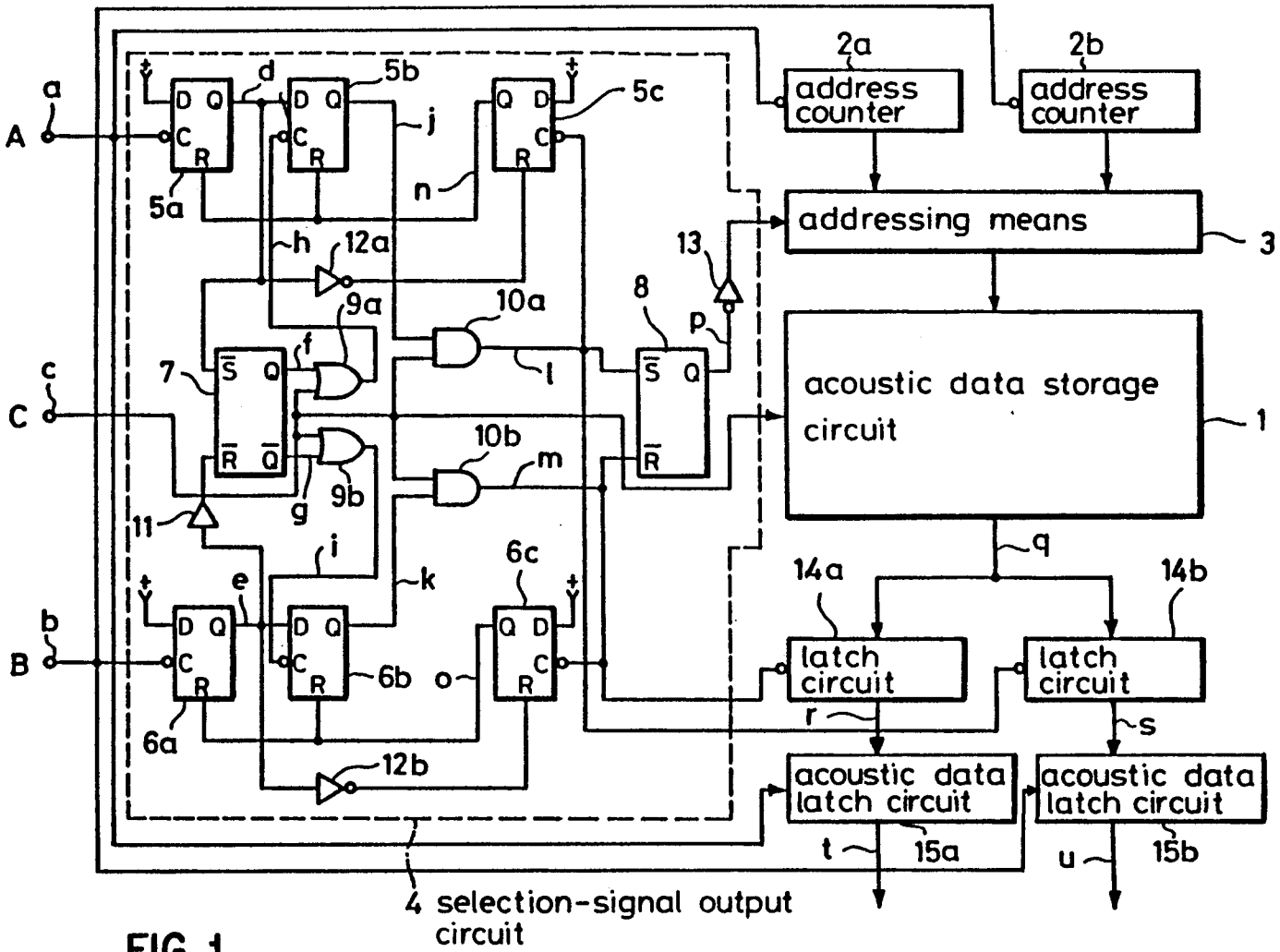
FIG. 1 is an electric circuit diagram showing an embodiment of the present invention.

Referring now to the drawings, in FIG. 1, 1 is an acoustic data storage circuit in which acoustic data for the generation of melodies, for example, PCM data representative of the fundamental waveform of one sound of a bell, is stored. 2*a* and 2*b* are address counters used in addressing the acoustic data storage circuit 1, 3 is an addressing means for selecting either address counter 2*a* or 2*b* and specifying an address corresponding to the count of the selected address counter, and 4 is a selection-signal output circuit for receiving clock signals A and B of different periods and delivering a selection signal indicating which of the address counters 2*a* and 2*b* is to be selected. 5*a* to 5*c* and 6*a* to 6*c* are flip-flop circuits of the D type, 7 and 8 are flip-flop circuits of the RS type, 9*a*, 9*b*, 10*a* and 10*b* are gate circuits, 11 is a delay circuit, and 12*a*, 12*b* and 13 are inverter circuits, these components constituting the selection-signal output circuit 4. 14*a* is a latch circuit for temporarily storing the acoustic data held at an address corresponding to the count of the address counter 2*a*, 14*b* is a latch circuit for temporarily storing the acoustic data held at an address corresponding to the count of the address counter 2*b*, 15*a* is an acoustic data latch circuit for delivering the acoustic data latched in the latch circuit 14*a* in synchronization with the clock signal A, and 15*b* is an acoustic data latch circuit for outputting the acoustic data latched in the latch circuit 14*b* in synchronization with the clock signal B.

The operation of the foregoing device will now be described with reference to the time chart of FIG. 2. Terminal c receives a clock signal C shown at a in FIG. 2, terminal a receives the clock signal A shown at b, and terminal b receives the clock signal B shown at c. The clock signals A and B have different periods.

Figure 2:
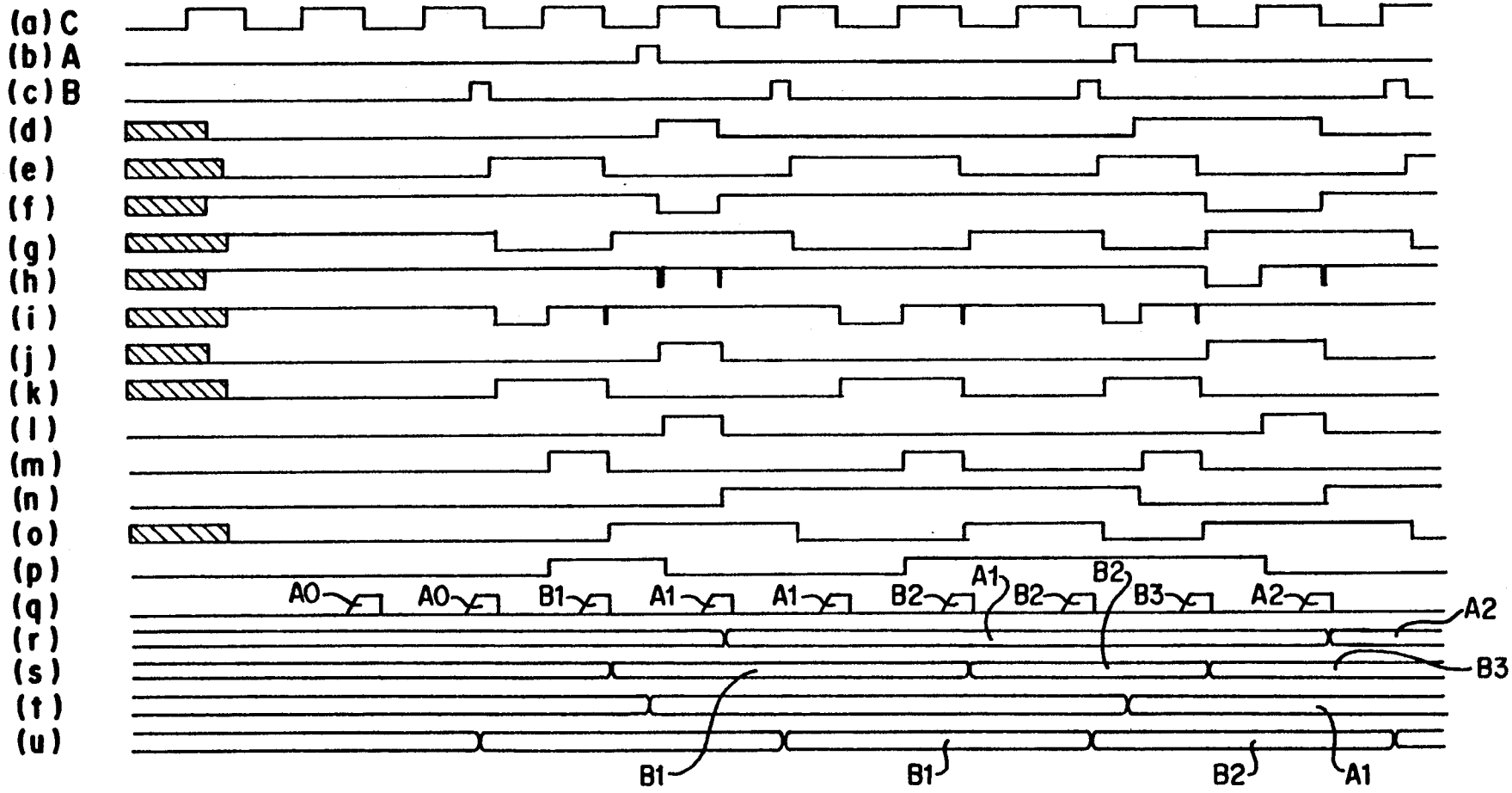
FIG. 2 is a time chart explanatory of the operation of the device of FIG. 1.

When the clock signal B is supplied, as shown at e in FIG. 2, upon the falling of the clock signal B, the output, i.e., the signal at terminal e, of the flip-flop circuit 6*a* becomes "1". Consequently, the flip-flop circuit 7 assumes the set state, so that its terminals f and g output "1" and "0" signals, respectively, which are applied to the gate circuits 9*a* and 9*b*, respectively. As a result, as shown at i in FIG. 2, the signal at terminal i becomes "0", so that the output, i.e., the signal at terminal k, of the flip-flop circuit 6*b* becomes "1". The signal at terminal k is combined with the clock signal C in the gate circuit 10*b*, so that the signal shown at m in FIG. 2 occurs at terminal m. Upon the rising of the signal at terminal m, the flip-flop circuit 8 assumes the set state, so that the signal at terminal p becomes "1", which is inverted in the inverter circuit 13 to "0" and applied to the addressing means 3.

Upon the falling of the signal at terminal m, the output, i.e., the signal at terminal o, of the flip-flop circuit 6*c* becomes "1", so that the flip-flop circuits 6*a* and 6*b* are reset.

When the output signal from the selection-signal output circuit 4 is "0", the addressing means 3 selects the address counter 2*b*, so that the acoustic data storage circuit 1 is addressed with an address corresponding to the count of the selected address counter. Assume, as shown at g in FIG. 2, that the acoustic data read out of the acoustic data storage circuit 1, i.e., the acoustic data corresponding to the count of the address counter 2*b*, is "$B_1$". The acoustic data storage circuit 1 delivers the acoustic data held at the address specified by the addressing means 3 in synchronization with the clock signal C. Although the acoustic data $B_1$ is applied to the latch circuits 14a and 14b, since at this time the signal at terminal m falls to "0" as shown at m in FIG. 2, the acoustic data $B_1$ is latched in the latch circuit 14b as shown at s in FIG. 2. The acoustic data latched in the latch circuit 14b is applied to the acoustic data latch circuit 15b, from which it is output in synchronization with the clock signal B as shown at u in FIG. 2.

In this way, individual pulses of the clock signal B are counted, and the acoustic data corresponding to the counted value is output in synchronization with the clock signal B.

When the clock signal A is supplied, as shown at d in FIG. 2, upon the falling of the clock signal A, the output, i.e., the signal at terminal d, of the flip-flop circuit 5a becomes "1". Consequently, the flip-flop circuit 7 assumes the reset state, so that terminals f, and g deliver "0" and "1" signals, respectively, which are applied to the gate circuits 9a and 9b, respectively. Therefore, as shown at h in FIG. 2, the signal at terminal h becomes "0", so that the output, i.e., the signal at terminal j, of the flip-flop circuit 5b becomes "1". The signal at terminal j is combined with the clock signal C in the gate circuit 10a, so that the signal shown at l in FIG. 2 is obtained at terminal l. Upon the rising of the signal at terminal l, the flip-flop circuit 8 assumes the reset state, so that the signal at terminal p becomes "0", which is inverted in the-inverter circuit 13 to "1" and applied to the addressing means 3.

Upon the falling of the signal at terminal l, the output, i.e., the signal at terminal n, of the flip-flop circuit 5c becomes "1", so that the flip-flop circuits 5a and 5b are reset.

When the output signal from the selection-signal output circuit 4 is "1", the addressing means 3 selects the address counter 2a to address the acoustic data storage circuit 1 with an address corresponding to the count of the selected address counter. Assume, as shown at g in FIG. 2, that the acoustic data read out of the acoustic data storage circuit 1, i.e., the acoustic data corresponding to the count of the address counter 2a, is "$A_1$". The acoustic data storage circuit 1 delivers the acoustic data held at the address specified by the addressing means 3 in synchronization with the clock signal C. Although the acoustic data $A_1$ is applied to the latch circuits 14a and 14b, since at this time the signal at terminal l falls to "0" as shown at l in FIG. 2, as shown at r in FIG. 2, the acoustic data $A_1$ is latched in the latch circuit 14a. The acoustic data latched in the latch circuit 14a is applied to the acoustic data latch circuit 15a, from which it is output in synchronization with the clock signal A as shown at t in FIG. 2.

In this way, individual pulses of the clock signal A are counted, and the acoustic data corresponding to the counted value is output in synchronization with the clock signal A.

The output of the latch circuits 15a and 15b is converted from digital to analog form and presented in the form of a melody, On the contrary, when the clock signals A and B are supplied concurrently, the signals at terminals d and e both become "1"; but, since the signal of "1" at terminal e is delayed in the delay circuit 11, the signal of "1" at terminal d is first applied to the flip-flop circuit 7 which thus assumes the reset state. Therefore, until the reading-in of the clock signal A is completed, the reading-in of the clock signal B is inhibited. That is, the clock signal A is read in preferentially.

As described above, the acoustic data read out in accordance with the address output of the address counter 2a based on the clock signal A is latched in the latch circuit 15a in serial manner, and the acoustic data read out in accordance with the address output of the address counter 2b based on the clock signal B is latched in the latch circuit 15b in serial manner. Therefore, it is possible to read out the single acoustic data on an independent basis by the use of the clock signals A and B which are out of synchronization; for example, by choosing the frequency of "1a" scale for the frequency of the clock signal A and the frequency of "do" scale for the frequency of the clock signal B, sounds of such two scales can be heard in overlapped mode as if bells are struck concurrently.

Although the foregoing embodiment uses two kinds of clock signals, the present invention should not be limited to such a system; for example, if the number of kinds of clock signals is increased to three or more and there are provided address counters, latch circuits, etc., correspondingly, sounds of three or more scales can be heard concurrently in overlapped mode.

According to the present invention, acoustic data can be read out of the single acoustic data storage circuit by the concurrent use of a plurality of clock signals independent of each other; thus, a plurality of sounds can be generated in overlapped mode without increasing the size of such a storage circuit.

Although the present invention has been described through specific terms, it should be noted here that the described embodiment is not necessarily exclusive and that various changes and modifications may be imparted thereto without departing from the scope of the invention which is limited solely by the appended claims.

What we claim is:

1. An acoustic data output device comprising a single acoustic data storage means for storing acoustic data, a plurality of address counters each coupled to address the single acoustic data storage means, each capable of independently counting in response to a corresponding one of a plurality of clock signals, selection-single output means connected to receive the plurality of clock signals and deliver a selection signal indicating which of the plurality of address counters is to be selected, said selection-signal output means including means for determining which of the plurality of address counters is to be selected when the plurality of clock signals are supplied concurrently, addressing means connected to select one of the plurality of address counters in accordance with the output signal from the selection-signal output means and to address the acoustic data storage means with an address corresponding to the count of the selected address counter, and a plurality of acoustic data latch means corresponding to the plurality of address counters for temporarily storing the acoustic data held at the address specified by the addressing means and outputting the temporarily-stored acoustic data in synchronization with the clock signal corresponding to the address counter selected by the addressing means.

2. An acoustic data output device comprising:

a single addressable memory for storing acoustic data, means for providing a plurality of clock signals, a plurality of address counters of a number corresponding to the number of said clock signals and connected to count separate ones of said clock signals, signal selection means responsive to said clock signals for providing an address counter selection signal, whereby at any given time said selection signal corresponds to a separate one of said address counters, said signal selection means comprising means for determining which of the plurality of address counters is to be selected when the plurality of clock signals are supplied concurrently, addressing means responsive to said address counter selection signal for selectively addressing said single addressable memory with the count of each of the corresponding address counters, a separate data latch means corresponding to each address counter and coupled to receive the output of said single addressable memory, and means for outputting the output of said data latch means in synchronization with the clock signal corresponding thereto.

3. The acoustic data output device of claim 2 wherein said means for determining which of the plurality of address counters is to be selected when the plurality of clock signals are supplied concurrently comprises means for delaying one of said clock signals.

4. A method for outputting acoustic data, comprising:

storing acoustic data in a single addressable memory, applying a plurality of clock signals to separate address counters, generating an address counter selection signal in response to said clock signals for providing an address counter selection signal, whereby at any given time said selection signal corresponds to a separate one of said address counters, said step of generating comprising providing an address counter selection signal corresponding to a predetermined address counter in response to the concurrent occurrence of a plurality of said clock signals, selectively addressing said single memory with the counts of each of said address counters in response to said address counter selection signal, selectively applying the output of said memory to separate data latches corresponding to said address counters, and outputting signals from said data latches in synchronism with the corresponding clock signal.

5. The acoustic data output device of claim 1 wherein said selection-signal output means comprises means for receiving the plurality of clock signals and delivering a selection signal indicating which of the plurality of address counters is to be selected.

* * * * *